United States Patent [19]

Østlund

[11] 4,416,565

[45] Nov. 22, 1983

[54] METHOD AND COLUMN FOR COLLECTION AND SEPARATION OF OIL, GAS AND WATER FROM BLOWING WELLS AT THE SEA BED

[76] Inventor: Øle C. Ostlund, Øvre Stokkavei 21, Stavanger, Norway

[21] Appl. No.: 280,005

[22] PCT Filed: Oct. 31, 1980

[86] PCT No.: PCT/NO80/00034

§ 371 Date: Jul. 1, 1981

§ 102(e) Date: Jul. 1, 1981

[87] PCT Pub. No.: WO81/01310

PCT Pub. Date: May 14, 1981

[30] Foreign Application Priority Data

Nov. 2, 1979 [NO] Norway ..... 793524

[51] Int. Cl.[3] ..... E02B 15/04

[52] U.S. Cl. ..... 405/60; 210/922; 405/210

[58] Field of Search ..... 405/60, 210; 210/922, 210/923; 166/357

[56] References Cited

U.S. PATENT DOCUMENTS

| | | | |
|---|---|---|---|
| 3,653,215 | 4/1972 | Crucet | 405/60 |
| 3,745,773 | 7/1973 | Cunningham | 405/60 |
| 3,762,548 | 10/1973 | McCabe | 405/60 X |
| 4,318,442 | 3/1982 | Lunde et al. | 405/60 X |
| 4,358,218 | 11/1982 | Graham | 405/60 |

FOREIGN PATENT DOCUMENTS

| | | | |
|---|---|---|---|
| 6805977 | 10/1968 | Netherlands | 405/60 |
| 1172558 | 4/1968 | United Kingdom . | |

*Primary Examiner*—Dennis L. Taylor

*Attorney, Agent, or Firm*—Scully, Scott, Murphy & Presser

[57] ABSTRACT

Method by collection and separation of oil, gas and water from an offshore oil/gas well (2) and a column (1) for usage by the same.

The column (1) comprising a vertically arranged tube (3) with a lower end (8) resting on the sea bed (14) and an upper closed end (9) from which gas may be discharged by gas outlet means (6). Oil-gas mixture flowing out of a well head (22) in operation of the column (1) will be retarded by an oil column (10) in the tube (3), thereby releasing gas which is collected in the upper portion (11) of the column. Motion of the oil at the surface of the oil column (10) will be very small, oil thereby flowing over an overflow rim (15) into an overflow channel (26), from where oil is transferred to the sea surface by oil outlet means (7).

The motion of the mixture may be additionally dampened by horizontal webs.

The column (1) may be operated at sea depths more than 300 meters and at shallow water where the column may be constructed as part of a platform.

15 Claims, 5 Drawing Figures

METHOD AND COLUMN FOR COLLECTION AND SEPARATION OF OIL, GAS AND WATER FROM BLOWING WELLS AT THE SEA BED

This invention relates to a method by collection and separation of oil, gas and water from an oil/gas well and a column for usage by the same.

During the last years many attempts have been made to control oil and gas streaming out of blowing oil/gas wells on the sea bed. Such attempts are undertaken to avoid pollution of the surrounding sea and sea-shores, highly being a danger for damaging marine life and pollutioning large sea-shore areas. Additionally high waste economic losses follow flowing of such wells.

Existing equipment of to-day, such as booms, skimmers, sombreros etc. have proved to be insufficient under prevailing weather conditions. Therefore, new ways had to be developed to collect and separate gas and oil blowing uncontrolled from wells at the sea bed.

Means therefore are required, which can collect and commercially utilize gas and oil from such wells during the period of time in which other means are working to control the blow out, e.g. drilling relief wells.

Means in the shape of sombreros, e.g. according to U.S. Pat. No. 3,664,136, have been put into action to avoid pollution of the sea water and the surroundings. The intention of such sombreros has been to collect the oil-gas mixture blowing out of the subsea oil well. Principal reasons for failure of such sombreros have been escape of oil and gas below the edge of the sombrero and the attempt to transfer the oil-gas mixture, usually from the top of the sombrero to the sea surface. Caused by the proportional expansion of the gas escaping from the oil-gas mixture, such attempt has serious problems during the significant expansion of the gas volume by transportation of the oil-gas mixture in risers up to the sea surface.

One criterion by controlling a blowing well using a structure arranged on the well is to separate oil from gas and to control the two components individually. Furthermore, the pressure increasing within the structure caused by the flowing gas-oil mixture has to be controlled and limited to a pressure which does not exceed the strength of the bearing soil. Otherwise damage to soil layer and oil/water piping will occur.

Separation of the gas from the oil, as gas and oil have quite different behaviours as to pressure drops and expansion, large pressure fluctuations caused by gas bubbles in transportation risers from the sea bed to the sea surface as well as cavitation problems in the pumps, will be required to avoid such problems.

For the requirements it should be demanded of structures as follows: Insignificant or no soil failure, limitation of pressure fluctuations, insignificant or no damage to flowlines on or near the sea bed, operational independency of water depths, easy and ready installation, reliability and mobility. Furthermore, demands to economical construction and maintainance as always will be important.

The problem of soil failure will arise when the structure covering the well head and having an open lower end placed on the sea bed, is filled with the oil-gas mixture from the well, causing pressure differences inside/-outside the structure. If the pressure difference outside and inside the structure near the sea bed exceeds 3–5 m $H_2O$, a breakdown of the soil normally will be expected. Such breakdowns normally will cause leakage at the sea bed surface or in the soil. Pressure fluctuations at the sea bed, e.g. at 300 m water depth, vary a lot more than the soil limit of 5 m $H_2O$. This low pressure difference limit of approximately 5 m $H_2O$ makes it necessary to be able to minimize the fluctuations in oil/gas pressure within any structure placed open to the sea bed.

While the pressure at the bottom of a structure will be equal to the height of the liquid in the structure times the specific gravity of the liquid plus the atmospheric pressure, the gas pressure within such a structure will be the same in all directions.

If gas and oil are transferred together through a riser where the pressure in the riser sections is depending upon the vertical position of the sections, the bottom pressure continuously will vary from time to time with the gas content in the riser as the hydrostatic pressure at the bottom causes the gas to displace the oil while expanding during its travel up the riser.

By separating the gas from the oil in such a degree that the gas content in the oil is drastically decreased, the fluctuations in the riser bottom pressure also will be substantially decreased. Such a separation is possible by obtaining a free oil level in a column, establishing an overlaying hat for the gas released from the oil. Such a gas hat thereby forming the top of a structure arranged over the blowing well.

The method and structure of the present invention avoid the failures and disadvantages of prior structures for collecting and/or separating oil and gas from blowing wells. According to the present invention the method comprises lowering of a vertically arranged column over a blowing well by supplying ballast to ballast tanks connected with the column, until the column rests on the sea bed around the well head, guiding oil-gas mixture from the well head into the column, thereby building up an oil column in the interior of the structural column and an upper gas portion in the column, the upwards directed motion of the oil-gas mixture thereby being retarded such that the motion of the mixture at the oil surface being substantially insignificant, the pressure and the amount of oil and gas in the structural column being controlled by actuation of valves for oil and gas outputs, the hydrostatic pressure outside and inside the lower edge of the column resting on the sea bed being substantially equal, thereby maintaining a gas portion in the upper portion of the column by discharging gas from the column through the sea surface and discharging oil from the oil column also to the sea surface.

A structure according to the present invention may have the shape of a column comprising a vertically arranged tube with an upper closed end having outlet means for gas, a lower end of the tube having means for supporting the column at the sea bed and the middle portion of the column having oil outlet means.

An overflow rim may be provided below the upper portion of the tube, whereby remaining gas in the upper part of the oil column is released from the oil well when the oil is flowing over the rim, the outlet means for oil being provided in an overflow channel below the overflow rim and between the rim and the interior wall of the tube.

The interior of the column may be provided with one or more substantially horizontal webs acting as dampers to the upwardly directed motion of the oil-gas mixture.

An outer casing may be provided around the column forming therebetween ballasting and storing tanks as well as installing spaces for valves, pipelines and tanks provided to control lowering and flotation of the column and the pressure inside the column when the column is in operation. A deck may be arranged, resting on the top of the casing, suitable for supporting necessary equipment for the operation of the column, the equipment on the platform being accessible for divers when the column is in operation at great depths.

From the column, oil and gas are separately transferred to the sea surface where further treatment may take place on barges, ships, platforms etc. before further transportation, or the gas may be burned.

The risers for such transfer of oil and gas may be fixed or flexible, depending on water depths and other circumstances. It is, however, anticipated that flexible risers might be the most economical solution for great depths, as such risers also allow the use of the system at different water depths without costly rearrangements.

The column principle can be applied for all water depths, subject to establishing a stage of pressure equilibrium, which is set by the following equation:

$$P+\rho_1 Hg=P_1+\rho_2 h_2 g$$

where

P=atmospheric pressure at sea level, $\rho_1$=specific gravity of water

H=water depth, $P_1$=gas pressure in top of column, $\rho_2$=specific gravity of oil in column, $h_2$=height of oil in column In order to limit the possibility of oil leakage under the bottom wall of the column, due to small pressure fluctuations, the bottom pressure in the column should be kept within the following ranges:

$$P+\rho_1 Hg>P_1+\rho_2 h_2 h>P+\rho_1 Hg-P_s$$

giving a pressure control span of $P_s$ where $P_s$=maximum soil differential pressure before soil breakdown.

If leakage under the bottom is allowed or controlled by means of skirts penetrated into the sea bed, where flow lines do not prevent this, the bottom pressure in the column can vary as follows:

$$P+\rho_1 Hg+P_s>P_1+\rho_2 h_2>P+\rho_1 Hg-P_s$$

giving a control span of $2P_s$.

During operation the oil from the well will flow freely into the column, the gas will separate and the system will establish its own state of equilibrium. Pressure built up at the bottom is avoided by throttling a bottom valve and/or a top valve. The oil in the column is flowing over the overflow rim prior to entering the transfer risers which will improve the separation of gas.

The dynamic energy in the blowing oil-gas mixture flowing upwards is dampened by the existing oil and water liquids in the column. To achieve this, the amount, diameter ahd height of water and oil in the column must be large enough to dampen and absorb the dynamic energy from the blowing oil-gas mixture. Furthermore, the dimensions must be large enough to let gas bubbles rise and expand without creating large fluctuations in the hydrostatic pressure at the bottom. This effect will decrease with increasing diameter and height. The required height of the oil/water column might be reduced by installation of mechanical damper or dampers in the column.

The invention is fully described by way of example with reference to the accompanying drawings, in which.

Figure 1:
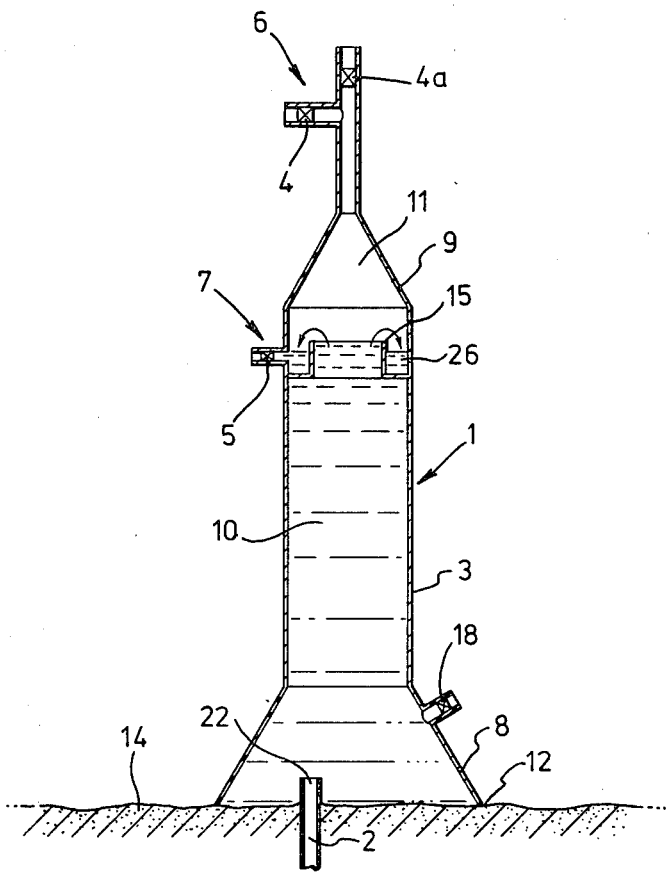
FIG. 1 shows an elevation of the column according to the present invention.
Figure 2:
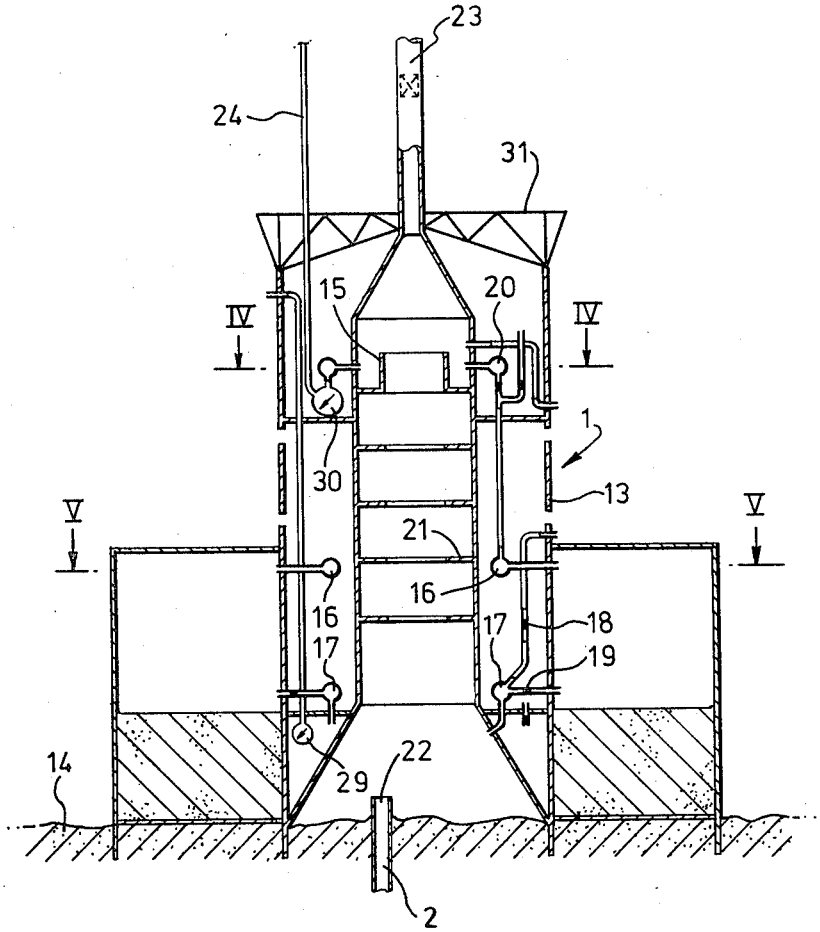
FIG. 2 shows the column of FIG. 1 with an outer casing, ballasting and storing tanks and an equipment deck accessible for divers as the column may be in operation on a sea bed.
Figure 3:
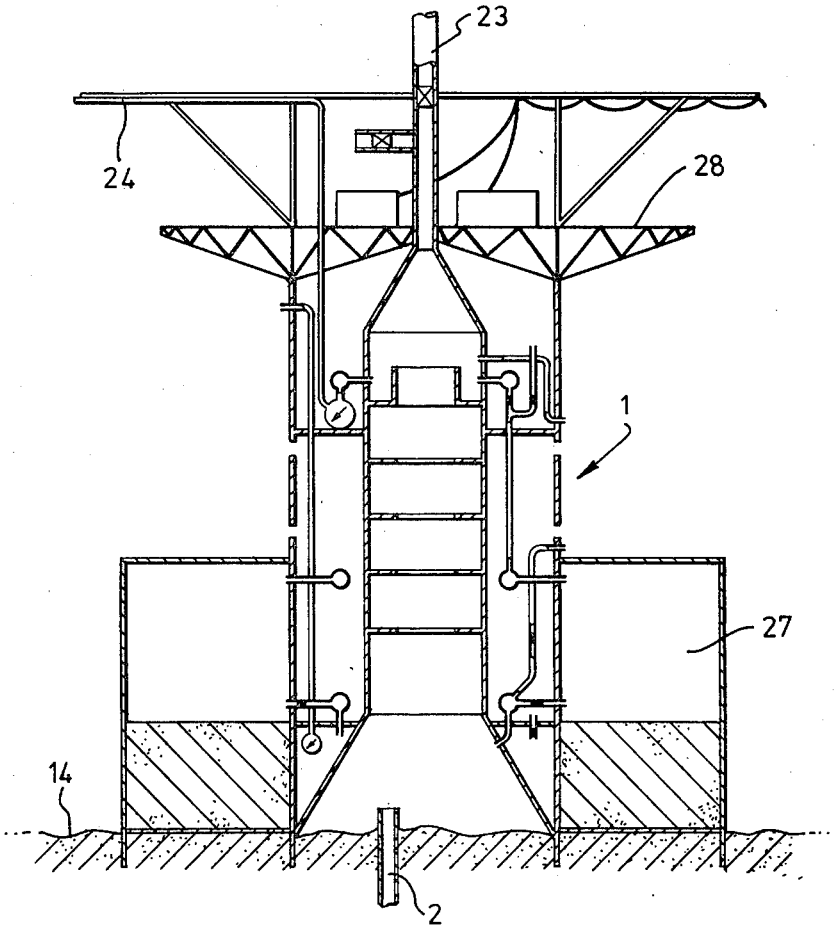
FIG. 3 shows a column constructed for shallow water with a platform deck above the sea surface.
Figure 4:
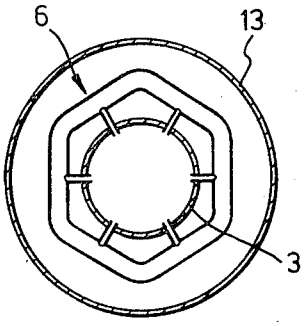
FIGS. 4 and 5 show cross-sections according to FIG. 2.
Figure 5:
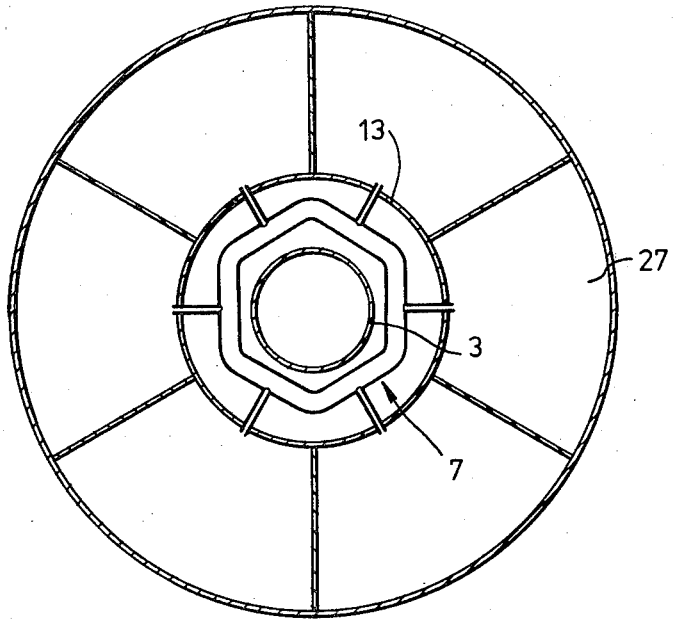

A vertically arranged column 1, in operation covering an oil/gas well 2, comprises a tube 3 having valves 4 and 4*a* and valve 5 constituting parts of outlet means 6 and 7 for gas and oil, respectively. The lower end 8 of the column 1 has a lower edge 12 resting on the sea bed 14. In the vertical tube 3 and the lower end 8 of the column 1 an oil column 10 will be built up during operation. An upper end 9 of the column contains an upper gas-filled portion 11 below which an overflow rim 15 is arranged for releasing gas from the oil-gas mixture as the mixture flows over the rim 15 and into an overflow channel 26 from which the oil is transferred to the sea surface by the outlet means 7. The lower end 8 of the column 1 is provided with a valve 18 for discharging water from the lower part of the column 1 and for buoyancy purposes by floating and lowering the column.

Oil-gas mixture flowing out of the well 2 through the well head 22 will be retarded by the fluid of the oil column 10. Gas will be released from the oil-gas mixture and find its way to the gas-filled portion 11. At the surface of the oil column 10 the motion of the oil-gas mixture is retarded to such an extent that the oil is substantially calm and most of the gas is released from the mixture. Possible remaining gas will be released from the mixture when flowing over the overflow rim 15 into the overflow channel 26. Water separated from the oil-gas mixture will establish a water-filled lower portion in the lower end 8 of the column 1, which water can be discharged from the column by valve 18. Valve 18 also may be used as supplementary discharging possibility to the outlet means 7 for oil by excessive flow into the column of oil-gas mixture.

Surrounding the column 1 an outer casing 13 is arranged spaced from the tube 3, thereby providing facilities for e.g. piping systems. Surrounding the casing 13 ballasting and storing tanks 27 may be arranged around the lower portion of the casing 13.

Water may be discharged from the lower end 8 of the column 1 through a manifold 17 to the surrounding sea or by valves 18 and 19 to storage tanks 27, from where it may be discharged by a pump 29 to the surrounding sea. The storage tanks 27 hereby being in operation as separating tanks for oil and water, the oil separated in the upper part of the tanks 27 may be discharged through a manifold 16 from which oil may be transferred to the sea surface or to a manifold 20 through which a pump 30 may discharge oil from the overflow channel 26 to the sea surface for further treatment.

To increase the retarding function of the oil column 10, one or more horizontal webs 21 may be arranged in the interior of the tube 3, such webs being designed as stiffeners for the tube 3.

The lower edge of the tube 3 may be designed as webs, boxes or sections of which certain ones may be removed to avoid damage on objects on or near the sea bed 14 around the well head 22, such as pipelines. Furthermore, the lower edge 12 may be designed to penetrate the sea bed thereby allowing a certain pressure difference between the inside and the outside of the lower end 8 of the column 1.

To avoid damage on flowlines and bottom risers at the sea bed, the lower edge 12 of the column 1 partly or totally may be provided with a water-filled flexible rubber cushion distributing the load of the column evenly on the sea bed.

The column 1 may be provided with an equipment deck 31 supporting necessary equipment for the piping systems of the entire column 1 and being accessible for divers when the column is in operation.

Further equipment is installed for purposes of measuring pressures at desired points of the column, the casing, the tanks, pumps, manifolds and the gas and oil transmitting devices 23, 24 respectively, and the discharging devices 6, 7 for gas and oil, respectively.

In operation the pressure in the lower end 8 of the column 1 by means of the afore-mentioned equipment and controlling devices, is maintained substantially equal to the pressure outside the column at the sea bed.

The column design is strongly related to the physical conditions under which the column will be in operation and towed offshore to a blowing well. Fulfilment of such requirements consequently will exceed the requirements put forward from the pressure conditions connected with the operation of the column, the column thereby being operational at depths down to more than 300 meters as well as in shallow water.

The column 1 may, if beneficial, also be used as an extra safety margin during drilling by placing the column over the bottom installed B.O.P. and drilling through the top of the column which has to be designed and equipped for such a purpose.

For use in shallow water the column may be provided with a fire wall and fire fighting devices withstanding burning oil and gas at the sea surface when installing the column.

Ballasting and storing tanks 27 may be used for trimming the load on the column structure when standing at the sea bed in order to keep it stable dependent on soil conditions of the particular well, in addition to ballasting during submergence and storing purposes for oil and/or water during operation.

During submergence valves 4, 4*a*, 5 and 18 are open to allow free flow of gas and oil through the column. After installation at the sea bed and required ballasting, the valves carefully are set and the oil pumps put into operation, the valves, pumps and other equipment being remotely controlled through lifelines from an operation barge, such equipment and piping systems normally being automatically controlled.

I claim:

1. A balancing column for collecting and separating gas, water and oil flowing from an underwater well head, said column comprising:

(a) a vertically arranged column, said column having ballasting means for lowering said column over said well head in a vertical position, said column having a closed upper end and an open lower end for supporting said column on the sea bed;

(b) an oil accumulator in the lower and middle portion of the column for dissipating the kinetic energy of an upflowing oil-gas mixture;

(c) a gas accumulator in the upper end of the column for accumulating gas as it separates from said oil-gas mixture;

(d) first and second valve means for equalizing the hydrostatic pressure inside and outside the lower edge of the column resting on the sea bed, said valve means regulating the accumulated oil and gas within the column to provide a positive engagement between the column and the sea bed, said first valve means discharging oil from said oil accumulator and said second valve means discharging gas from said gas accumulator at predetermined rates for said equalization;

whereby the positive engagement between the column and the sea bed is maintained to prevent a breakout of the sea bed below the column.

2. A balancing column for collecting and separating gas, water and oil flowing from an underwater well head as claimed in claim 1 which further comprises an oil-gas separator means mounted between said oil accumulator and said gas accumulator.

3. A balancing column for collecting and separating gas, water and oil flowing from an underwater well head as claimed in claim 2 which further comprises an overflow rim mounted below said gas accumulator adjacent said first valve means, whereby any remaining gas in the oil will be released when oil flows over the said rim.

4. A column according to claim 1 or 2 wherein said column is provided with at least one horizontal interior web for damping the upwardly directed motion of the oil-gas mixture.

5. A column according to claims 1 or 2 wherein the second valve means further comprises at least one conduit for connection with storage means for gas on the sea surface.

6. A column according to claims 1 or 2 wherein said second valve means further comprises a valve vertically arranged in the top of the column, allowing drilling operations from the sea surface through the valve and the entire height of the column.

7. A column according to claims 1 or 2 wherein said first valve means further comprises a manifold and at least one conduit for connection to oil storage means on the sea surface.

8. A column according to claims 1 or 2 which further includes a tubular casing arranged around the column, thereby providing a space between the tube and the casing to install valves, pumps and pipes, said casing protruding upwardly from the lower end of the column.

9. A column according to claims 1 or 2 that further includes outwardly extending sectional means for supporting the column on the sea bed, said means having sections which may be removed to avoid damage to objects on or near the sea bed around the well head.

10. A column according to claims 1 or 2 wherein the lower end of the column is provided with a third valve means for transfer of liquid into and out of the lower end of the tube.

11. A method of collecting and separating gas, oil, and water flowing from an under water well head, said method comprising:

(a) ballasting a vertically arranged column over the well by filling one or more ballast tanks mounted on the column, until the column rests on the sea bed above the well head;

(b) filling the interior of the column with the oil-gas mixture from the well head to form a vertical column of oil;

(c) retarding the kinetic energy of the oil-gas mixture by directing the up-flowing mixture into said column of oil;

(d) separating the oil and gas mixture and providing a gas accumulator in the upper portion of the column;

(e) equalizing the hydrostatic pressure inside and outside the lower edge of the column resting on the sea bed by regulating the accumulated gas pressure within the gas accumulator;

whereby a positive engagement between the column and the sea bed is maintained to prevent a breakout of the sea bed below the column.

12. A method of collecting and separating gas, oil, and water as claimed in claim 11 which further comprises the step of regulating the flow of oil from the column of oil to equalize the hydrostatic pressure between the inside and outside of the lower edge of the column.

13. A method of collecting and separating gas, oil, and water as claimed in claim 11 or 12 wherein the hydrostatic pressure is equalized by adjusting the oil and gas pressures as follows:

$$P+p_1Hg=P_1+p_2h_2g$$

wherein:

P=atmospheric pressure at sea level, $p_1$=specific gravity of the water in which the column is located H=the water depth at the sea bed $p_1$=the gas pressure in the top of the column $p_2$=the specific gravity of oil in the column, and $h_2$=the height of the oil in the column.

14. A method of collecting and separating gas, oil, and water as claimed in claim 11, wherein the oil pressure at the bottom of the column is maintained within the following ranges:

$$P+p_1Hg>P_1+p_2h_2h>P+p_1Hg-P_s$$

wherein $P_s$ is the maximum pressure permissible before soil breakout occurs.

15. A balancing column for collection and separation of gas, water and oil which, controlled or not, is flowing out of an oil/gas well on a sea bed, characterized in that the column comprises a vertically arranged tube with an upper closed end having an outlet means for gas, a lower end of the tube having means for supporting the column on the sea bed, a middle portion of the tube having an oil outlet means for tranferring oil to the sea surface, and an overflow rim mounted in said tube below an upper portion of the tube that collects release gas, whereby remaining gas in the oil will be released when oil flows over the rim, said oil outlet means opening into an overflow channel between the interior wall of the tube and the rim at a level below the rim, and a lower end of the tube having valve means for liquid passage through the lower end of the column to equalize the hydrostatic pressure inside and outside the lower edge of the column when in operation.

* * * * *

UNITED STATES PATENT AND TRADEMARK OFFICE

CERTIFICATE OF CORRECTION

PATENT NO. : 4,416,565

DATED : November 22, 1983

INVENTOR(S) : Ole C. Ostlund

It is certified that error appears in the above-identified patent and that said Letters Patent is hereby corrected as shown below:

Column 3, line 58, "ahd" should read -- and --.

Column 8, claim 13, line 4, "$p_1$" should read -- $P_1$ --.

Signed and Sealed this

*Twenty-seventh* Day of *March 1984*

[SEAL]

*Attest:*

GERALD J. MOSSINGHOFF

*Attesting Officer*

*Commissioner of Patents and Trademarks*